US005645436A

United States Patent [19]

Shimizu et al.

[11] Patent Number: 5,645,436

[45] Date of Patent: Jul. 8, 1997

[54] IMPEDANCE MATCHING TYPE ELECTRICAL CONNECTOR

[75] Inventors: Manabu Shimizu; Hideo Miyazawa, both of Kawasaki, Japan

[73] Assignee: Fujitsu Limited, Kawasaki, Japan

[21] Appl. No.: 723,290

[22] Filed: Sep. 30, 1996

Related U.S. Application Data

[63] Continuation of Ser. No. 425,767, Apr. 20, 1995, abandoned, which is a continuation of Ser. No. 183,311, Jan. 19, 1994, abandoned.

[30] Foreign Application Priority Data

Feb. 19, 1993 [JP] Japan ..... 5-030900

[51] Int. Cl.[6] ..... H01R 13/658

[52] U.S. Cl. ..... 439/108; 439/608

[58] Field of Search ..... 439/101, 108, 439/608

[56] References Cited

U.S. PATENT DOCUMENTS

| | | | |
|---|---|---|---|
| 4,846,727 | 7/1989 | Glover et al. | 439/108 |
| 4,975,084 | 12/1990 | Fedder et al. | 439/108 |
| 5,104,341 | 4/1992 | Gilissen et al. | 439/608 |
| 5,195,899 | 3/1993 | Yatsu et al. | 439/101 |
| 5,238,414 | 8/1993 | Yaegashi et al. | 439/608 |

*Primary Examiner*—Gary F. Paumen
*Attorney, Agent, or Firm*—Staas & Halsey

[57] ABSTRACT

A plug connector includes a plug housing made of an insulator material, a plurality of male signal terminals arranged in a plurality of columns and rows and fixed to the plug housing, and plate-shaped male conductors respectively having ground lead ends and fixed to the plug housing so that each male conductor is positioned between two adjacent rows formed by the male signal terminals. A corresponding jack connector forms an impedance matching type electrical connector together with the plug connector. The jack connector includes a jack housing made of an insulator material, a plurality of fork-shaped female signal terminals arranged in a plurality of columns and rows and fixed to the jack housing so that forks of the female signal terminals face a direction in which the rows extend, and a plurality of fork-shaped female conductor terminals respectively having a ground lead end and fixed to the jack housing so that each female conductor terminal is positioned between two adjacent rows formed by the female signal terminals and the forks of the female conductor terminals face a direction in which the rows extend.

15 Claims, 15 Drawing Sheets

$P_4$=1.27mm
$W_4$=12.7mm
$P_5$=1.27mm

IMPEDANCE MATCHING TYPE ELECTRICAL CONNECTOR

This application is a continuation of application Ser. No. 08/425,767, filed Apr. 20, 1995, now abandoned which is a continuation of application Ser. No. 08/183,311, filed Jan. 19, 1994, now abandonded.

BACKGROUND OF THE INVENTION

The present invention generally relates to impedance matching type electrical connectors, and more particularly to an impedance matching type electrical connector applicable to the connection of a mother board and a CPU (central processing unit) board which is mounted with a CPU in computer systems.

In computer systems, a plurality of CPU boards are provided as options. A desired CPU board is connected to a mother board via an electrical connector, so that it is possible to freely improve the functions and the like of the computer system.

The electrical connector must have an impedance characteristic which matches an impedance characteristic of the mother board, so that unwanted signal reflection or the like will not occur at the electrical connector. Generally, the impedance of the mother board is 50Ω.

When realizing the required impedance matching, it is most desirable to use a coaxial connector. However, a microstrip line structure or a strip line structure, having a provisionally coaxial structure, becomes more appropriate for use in the electrical connector from the point of view of the required space and cost as the number of pins or electrodes becomes large. But when the electrical connector having the microstrip line structure is used to realize the impedance matching between the mother board and the CPU board, there are problems in that the impedance becomes unstable and the crosstalk becomes high. Accordingly, it is preferable to employ the strip line structure to realize the impedance matching.

On the other hand, the number of pins of the electrical connector is approximately 300 and tends to increase with the increasing kinds of signals to be processed in the computer system.

Furthermore, there are demands to minimize the size of the electrical connector, so as to minimize the mounting space on the mother board occupied by the electrical connector. In addition, there are also demands to minimize the cost of the electrical connector.

Next, a description will be given of an impedance matching type electrical connector proposed in a U.S. patent application Ser. No. 882,005 filed May 13, 1992, which issued as U.S. Pat. No. 5,195,899 on Mar. 23, 1993 and has the same assignee as the present application, by referring to FIGS.1 through 5.

FIG. 1 shows a cross sectional view of an electrical connector 10, FIG. 2 shows an enlarged perspective view of a plug connector member 11 with a part thereof omitted, and FIG. 3 shows an enlarged perspective view of a jack connector member 12 with a part thereof omitted. FIG. 4 is a diagram for explaining the impedance matching of the electrical connector 10, and FIG. 5 shows a conceivable structure based on the basic structure of the electrical connector 10.

As shown in FIG. 1, the electrical connector 10 includes the plug connector member 11 and the jack connector member 12 which is engaged by the plug connector member 11. The jack connector member 12 is fixed on a mother board 18, while the plug connector member 11 is fixed on a CPU board 19.

As also shown in FIGS.2 and 4, the plug connector member 11 includes a main body 13 made of a synthetic resin, a first male signal terminal group 14 fixed to the main body 13 and forming a first column, a second male signal terminal group 15 fixed to the main body 13 and forming a second column, a male ground terminal plate 16 fixed to the main body 13 and positioned between the first and second male signal terminal groups 14 and 15, and a grounding shell 17 made of a metal and surrounding the main body 13.

On the other hand, as also shown in FIGS.3 and 4, the jack connector member 12 includes a main body 20 made of a synthetic resin, a first female signal terminal group 21 assembled in the main body 20 and forming a first column, a female ground terminal group 22 assembled in the main body 20, and a second female signal terminal group 23 assembled in the main body 20 and forming a second column.

As shown in FIG. 1, the grounding shell 17 of the plug connector member 11 engages the periphery of the main body 20 when the plug connector member 11 electrically connects to the jack connector member 12. More particularly, the first male signal terminal group 14 engages the first female signal terminal group 21, the second male signal terminal group 15 engages the second female signal terminal group 23, and the male ground terminal plate 16 engages the female ground terminal group 22.

As shown in FIG. 4, the first male signal terminal group 14 and the first female signal terminal group 21, the male ground terminal plate 16 (the female ground terminal group 22), and one sidewall **17*a* of the grounding shell 17** form a strip line structure.

Similarly, the second male signal terminal group 15 and the second female signal terminal group 23, the male ground terminal plate 16 (the female ground terminal group 22), and a sidewall **17*b* on the opposite side of the grounding shell 17** form a strip line structure.

Accordingly, the impedance of the electrical connector 10 is 50Ω, and an impedance matching is made between the mother board 18 and the CPU board 19.

But if the number of pins were to be increased by simply increasing the number of terminals extending in the two columns, the electrical connector would become extremely thin and long, and the mechanical strength of the electrical connector would become poor.

Accordingly, it is conceivable to increase the number of pins based on the basic structure of the electrical connector 10, as shown in FIG. 5. In FIG. 5, a male ground terminal plate (female ground terminal group) is arranged between two adjacent columns of terminals, and the number of columns of male signal terminal groups is increased to four columns.

In other words, in FIG. 5, the male ground terminal plate 16 is arranged between the first male signal terminal group 14 and the second male signal terminal group 15, a male ground terminal plate 16-1 is arranged between the second male signal terminal group 15 and a third male signal terminal group 30, and a male ground terminal plate 16-2 is arranged between the third male signal terminal group 30 and a fourth male signal terminal group 31.

But according to the conceivable structure shown in FIG. 5, a pitch $P_1$ between the two adjacent columns of terminals becomes large, that is, approximately 2.6 mm, for example.

As a result, a width $W_1$ of the plug connector member 11 becomes considerably larger than expected, and it is impossible to reduce the size of the electrical connector. In addition, because the grounding shell 17 is made of a metal, the cost of the electrical connector becomes high due to the large plug connector member 11.

SUMMARY OF THE INVENTION

Accordingly, it is a general object of the present invention to provide a novel and useful impedance matching type electrical connector in which the problems described above are eliminated.

Another and more specific object of the present invention is to provide a plug connector comprising a plug housing made of an insulator material, a plurality of male signal terminals arranged in a plurality of columns and rows and fixed to the plug housing, and plate-shaped male conductors respectively having ground lead ends and fixed to the plug housing so that each male conductor is positioned between two adjacent rows formed by the male signal terminals. According to the plug connector of the present invention, it is possible to form the strip line structure because the plate-shaped male conductors are positioned between the rows instead of between the columns. In addition, it is possible to increase the number of columns without greatly increasing the width of the plug connector. As a result, the size of the plug connector can be made compact regardless of the large number of pins provided.

Still another object of the present invention is to provide the plug connector described above, wherein each male conductor further has first and second ear portions bent on both ends of the male conductor in a direction taken along a width of the male conductor, the first ear portions confront the individual male signal terminals which form a first column and are arranged along the first column, and the second ear portions confront the individual male signal terminals which form a last column and are arranged along the last column. According to the plug connector of the present invention, the ear portions which are arranged have the function of surrounding the male signal terminal group, and it is possible to take measures against the electro-magnetic interference without the use of a metal shell. In addition, the number of parts does not increase by the provision of the ear portions because the ear portions are portions of the male conductors. Accordingly, compared to the conventional case, it is possible to provide sufficient measures against the electro-magnetic interference at a low cost and without increasing the number of parts.

A further object of the present invention is to provide the plug connector described immediately above, wherein the first and second ear portions are bent in mutually opposite directions on both ends of each male conductor. According to the plug connector of the present invention, it is possible to facilitate the mounting process because the male conductor can be mounted facing either direction. Compared to the case where the two ear portions face the same direction, it is possible to more stably press-fit the male conductors within the plug housing.

Another object of the present invention is to provide the plug connector described first above, wherein the plug housing includes peripheral sidewalls forming a recess on an inside, the peripheral sidewalls have grooves on inner peripheral surfaces thereof, each male conductor has first and second ear portions bent on both ends of the male conductor in a direction taken along a width of the male conductor, and the first and second ear portions fit within the corresponding grooves of the peripheral sidewalls. According to the plug connector of the present invention, it is possible to prevent the ear portions from being unwantingly deformed. In addition, it is possible to stably take measures against the electro-magnetic interference. Further, it is possible to smoothly connect the plug connector to a corresponding jack connector.

Still another object of the present invention is to provide a jack connector comprising a jack housing made of an insulator material, a plurality of fork-shaped female signal terminals arranged in a plurality of columns and rows and fixed to the jack housing so that forks of the female signal terminals face a direction in which the rows extend, and a plurality of fork-shaped female conductor terminals respectively having a ground lead end and fixed to the jack housing so that each female conductor terminal is positioned between two adjacent rows formed by the female signal terminals and the forks of the female conductor terminals face a direction in which the rows extend. According to the jack connector of the present invention, it is possible to densely arrange the female signal terminals in the column direction with a narrow pitch between the rows.

A further object of the present invention is to provide an impedance matching type electrical connector comprising a plug connector member, and a jack connector member engageable to the plug connector, where the plug connector member comprises a plug housing made of an insulator material, a plurality of male signal terminals arranged in a plurality of columns and rows and fixed to the plug housing, and plate-shaped male conductors respectively having ground lead ends and fixed to the plug housing so that each male conductor is positioned between two adjacent rows formed by the male signal terminals, and the jack connector member comprises a jack housing made of an insulator material, a plurality of fork-shaped female signal terminals, adapted to engage the male signal terminals of the plug connector member when the jack connector member and the plug connector member connect, and arranged in a plurality of columns and rows and fixed to the jack housing so that forks of the female signal terminals face a direction in which the rows extend, and a plurality of fork-shaped female conductor terminals respectively having a ground lead end and fixed to the jack housing so that each female conductor terminal is positioned between two adjacent rows formed by the female signal terminals and the forks of the female conductor terminals face a direction in which the rows extend. According to the impedance matching type electrical connector of the present invention, it is possible to realize a satisfactory impedance matching and take sufficient measures against the electro-magnetic interference. In addition, it is possible to realize an electrical connector which is compact and inexpensive.

Another object of the present invention is to provide the impedance matching type electrical connector described above, wherein each male conductor further has plate portions, and first and second ear portions bent on both ends of the male conductor in a direction taken along a width of the male conductor on both sides of the plate portions, the first ear portions confront the individual male signal terminals which form a first column and are arranged along the first column, the second ear portions confront the individual male signal terminals which form a last column and are arranged along the last column, the plate portions of the male conductors engage the female conductor terminals when the jack connector member and the plug connector member connect, each female conductor terminal has a pair of fork-shaped terminal portions, and each fork-shaped terminal portion pinches the plate portion of a corresponding one of the male conductors and makes contact at four positions of the plate portion. According to the impedance matching type electrical connector of the present invention, it is possible to effectively reduce the contact resistance between the male conductor and the female conductor, thereby realizing a stable impedance matching.

Other objects and further features of the present invention will be apparent from the following detailed description when read in conjunction with the accompanying drawings.

DESCRIPTION OF THE PREFERRED EMBODIMENTS

First, a description will be given of the operating principle of the present invention, by referring to FIG. 6.

Figure 6:
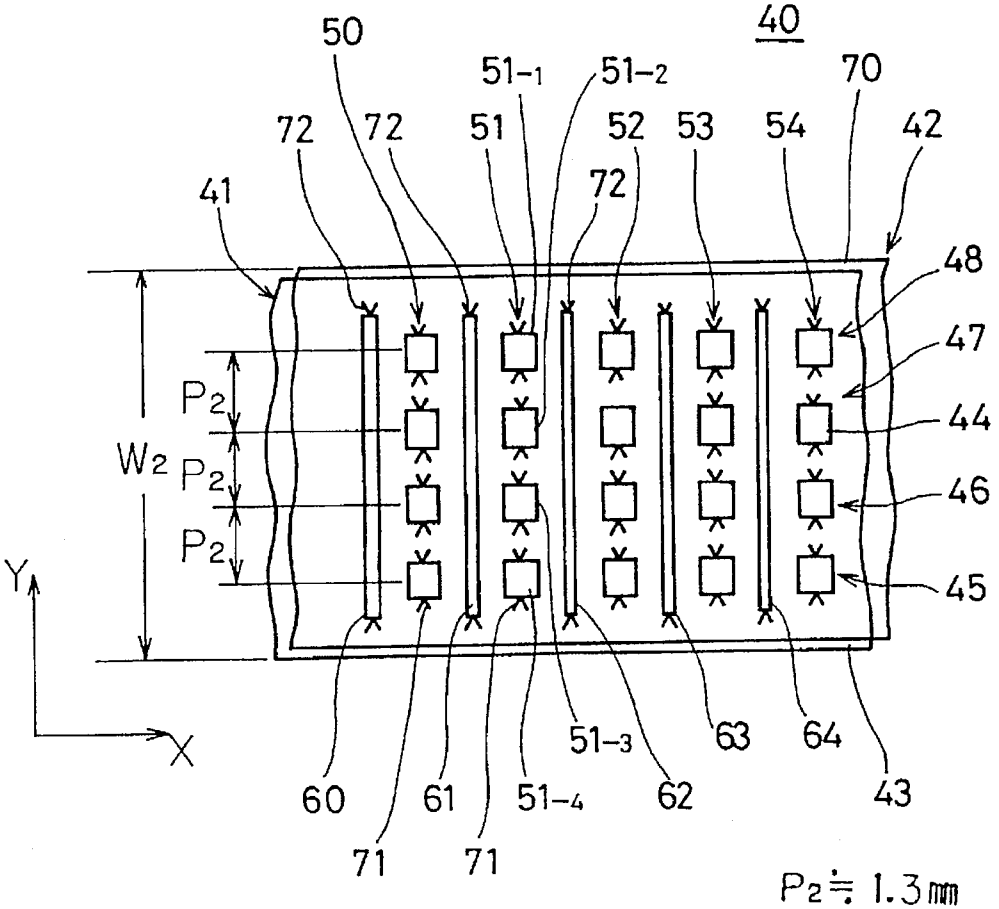
FIG. 6 is a diagram for explaining the operating principle of the present invention.

An impedance matching type electrical connector 40 according to the present invention includes a plug connector member 41, and a jack connector member 42 which engages the plug connector member 41, as shown in FIG. 6.

The plug connector member 41 includes a plug housing 43 made of an insulator material, a plurality of male signal terminals 44 fixed to the plug housing 43 and aligned in a plurality of rows and columns, and plate-shaped male conductors 60 through 64 fixed to the plug housing 43. In FIG. 6, an arrangement of the male signal terminals 44 along a direction X forms one column, and an arrangement of the male signal terminals 44 along a direction Y forms one row. Hence, FIG. 6 shows four columns and five rows of male signal terminals 44.

The male signal terminals 44 form a first male signal terminal group 45 forming a first column, a second male signal terminal group 46 forming a second column, a third male signal terminal group 47 forming a third column, and a fourth male signal terminal group 48 forming a fourth column.

In addition, the male signal terminals 44 also form a fifth male signal terminal group 50 forming a first row, a sixth male signal terminal group 51 forming a second row, a seventh male signal terminal group 52 forming a third row, an eighth male signal terminal group 53 forming a fourth row, and a ninth male signal terminal group 54 forming a fifth row.

For example, the sixth male signal terminal group 51 is made up of four male signal terminals 51-1 through 51-4, where the suffix indicates the column number.

The male conductors 60 through 64 include ground lead ends (not shown), and each male conductor is positioned between two adjacent rows so as to partition the male signal terminals groups forming the adjacent rows. The male conductor 61 is positioned between the fifth male signal terminal group 50 forming the first row and the sixth male signal terminal group 51 forming the second row. The male conductor 62 is positioned between the sixth male signal terminal group 51 forming the second row and the seventh male signal terminal group 52 forming the third row.

On the other hand, the jack connector member 42 includes a jack housing 70 made of an insulator material, and female signal terminals 71 and female conductor terminals 72 which are fixed to the jack housing 70. The female signal terminals 71 are arranged at positions corresponding to the positions of the male signal terminals 44. In addition, the female conductor terminals 72 are arranged at positions corresponding to the positions of the male conductors 60 through 64.

When the plug connector member 41 engages with the jack connector member 42, the male signal terminals 44 engage the corresponding female signal terminals 71, and the male conductors 60 through 64 engage the corresponding female conductor terminals 72.

In the second row, each of the male signal terminals 51-1 through 51-4 and the female signal terminals 71 engaging therewith confront the male conductor 60 on one side and confront the other male conductor 62 on the other side, thereby forming the strip line structure. Similarly, the strip line structure is formed by the male signal terminals 51 of each of the other rows.

Figure 1:
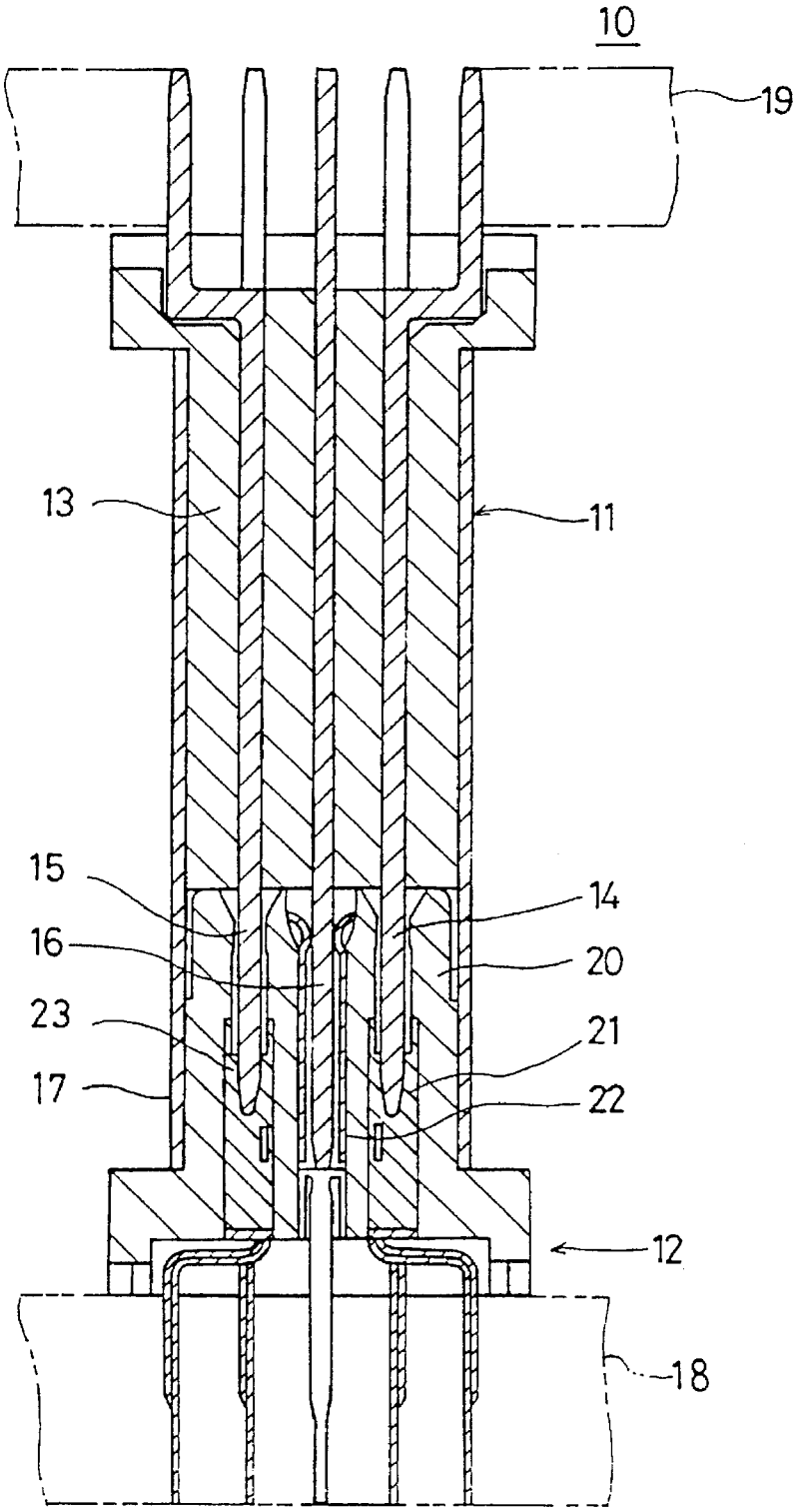
FIG. 1 is a cross sectional view showing an electrical connector.
Figure 2:
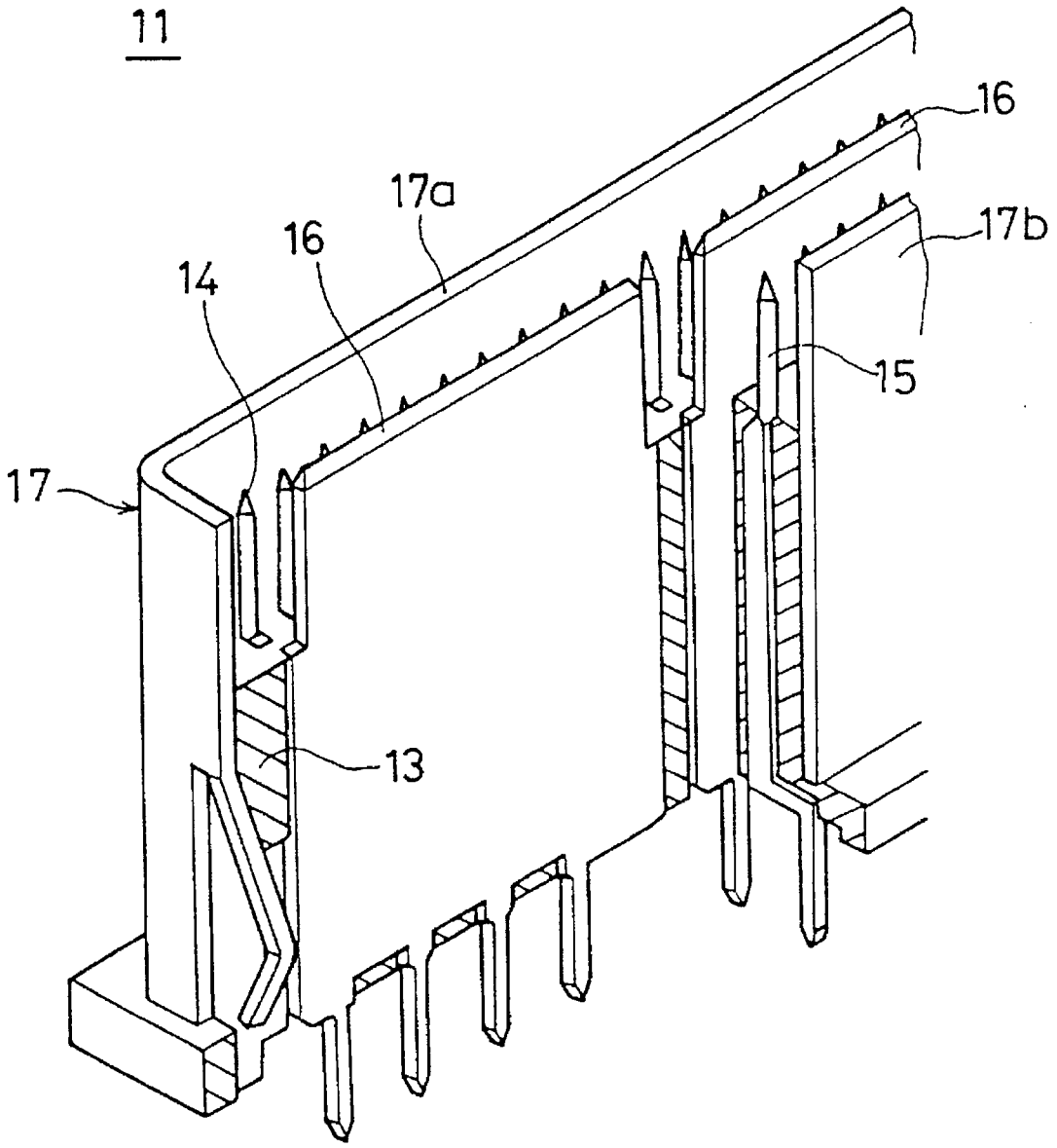
FIG. 2 is an enlarged perspective view showing a plug connector member with a part thereof omitted.
Figure 3:
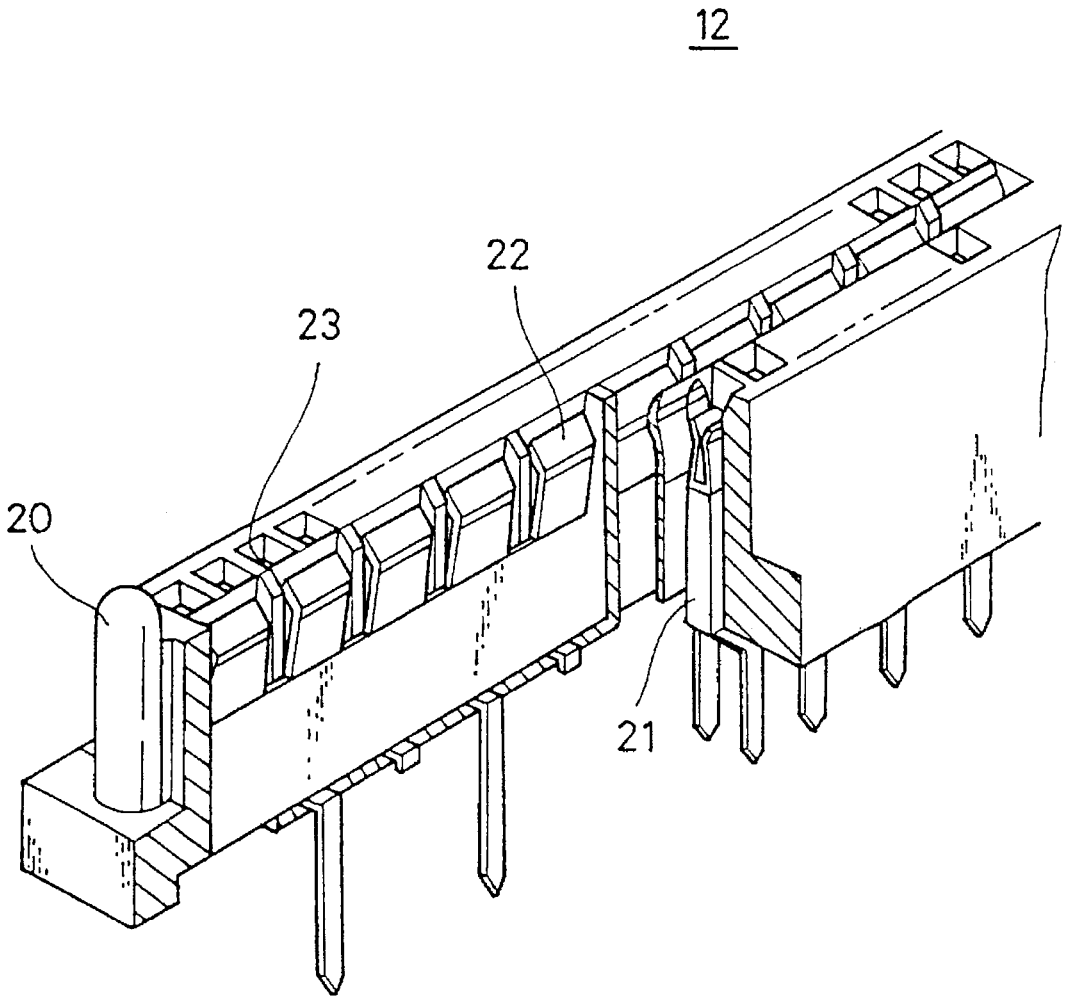
FIG. 3 is an enlarged perspective view showing a jack connector member with a part thereof omitted.
Figure 4:
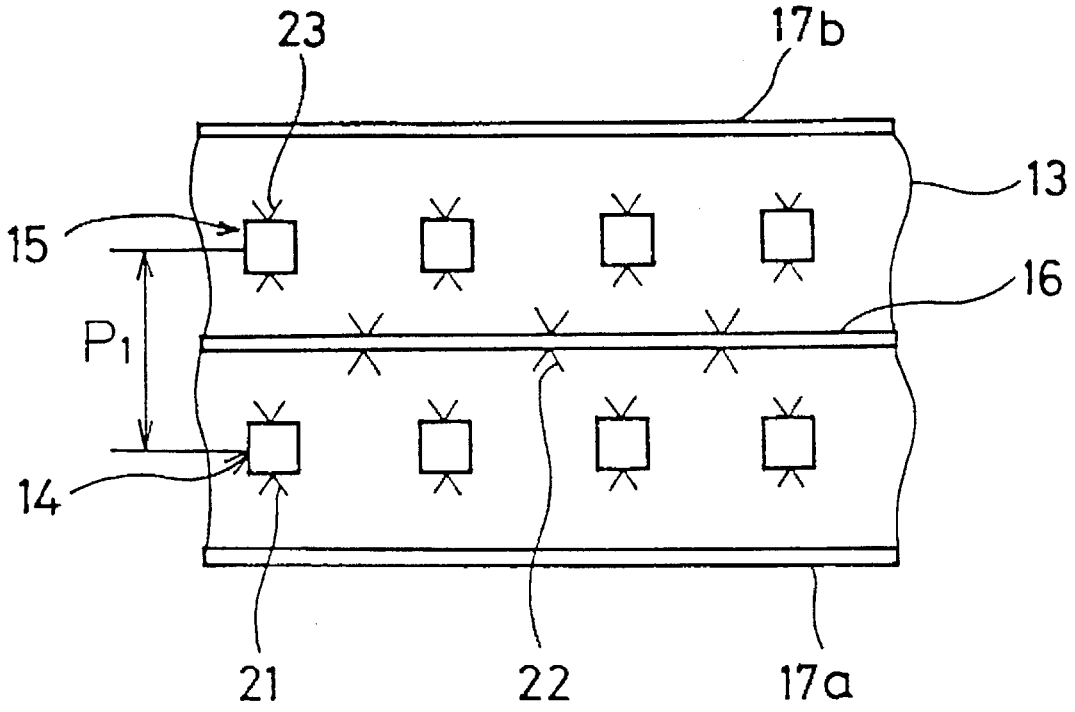
FIG. 4 is a diagram for explaining the impedance matching of the electrical connector shown in FIG. 1.
Figure 5:
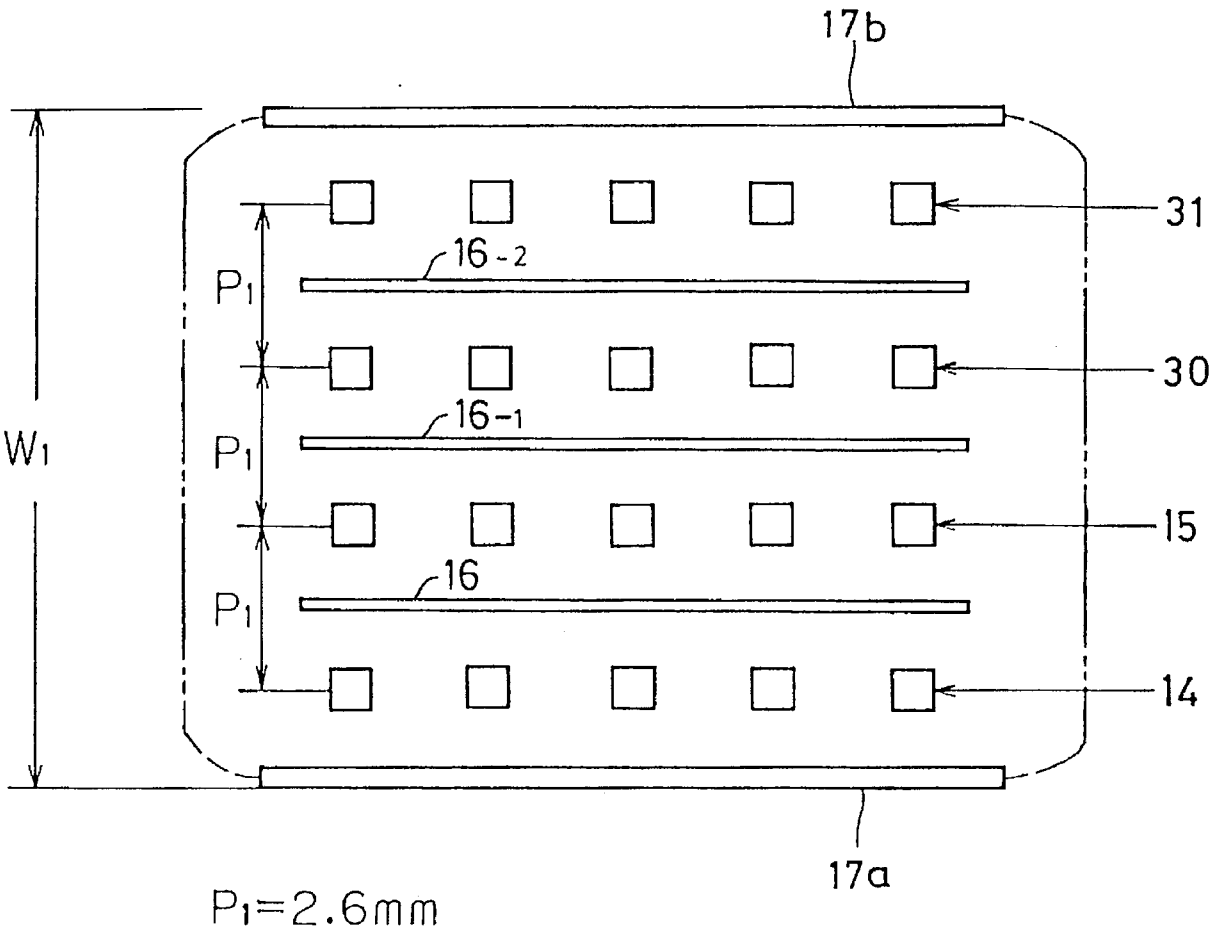
FIG. 5 is a diagram showing a conceivable structure based on the basic structure of the electrical connector shown in FIG. 1.

No obstructing structure is interposed between two adjacent columns of the male signal terminals 44. Accordingly, a pitch $P_2$ between two adjacent columns can be made approximately 1.27 mm which is approximately one-half the pitch $P_1$ shown in FIG. 4. For this reason, a width $W_2$ of this electrical connector 40 is small.

Next, a description will be given of an embodiment of the impedance matching type electrical connector according to the present invention, by referring to FIGS.7 through 15.

Figure 7:
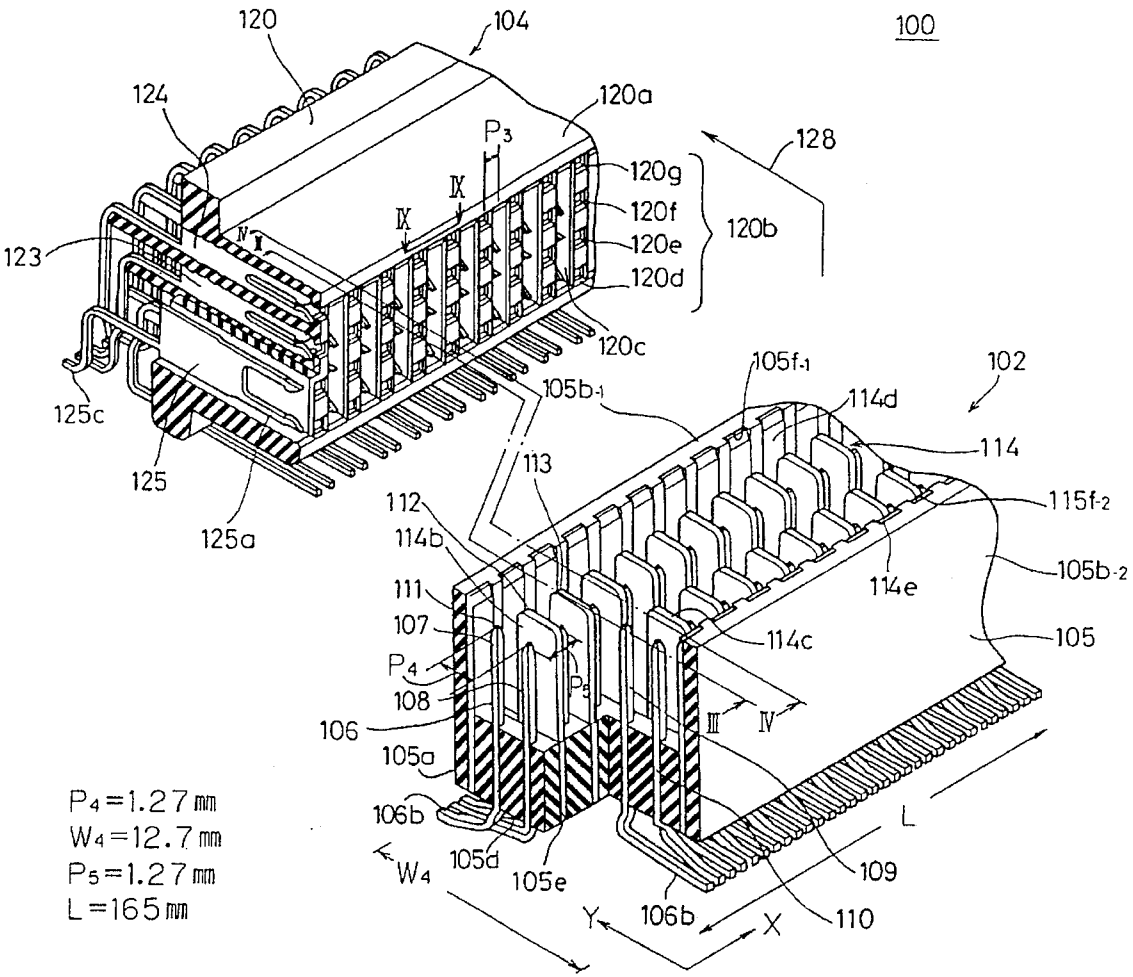
FIG. 7 is a perspective view showing an embodiment of an impedance matching type electrical connector according to the present invention.
Figure 8:
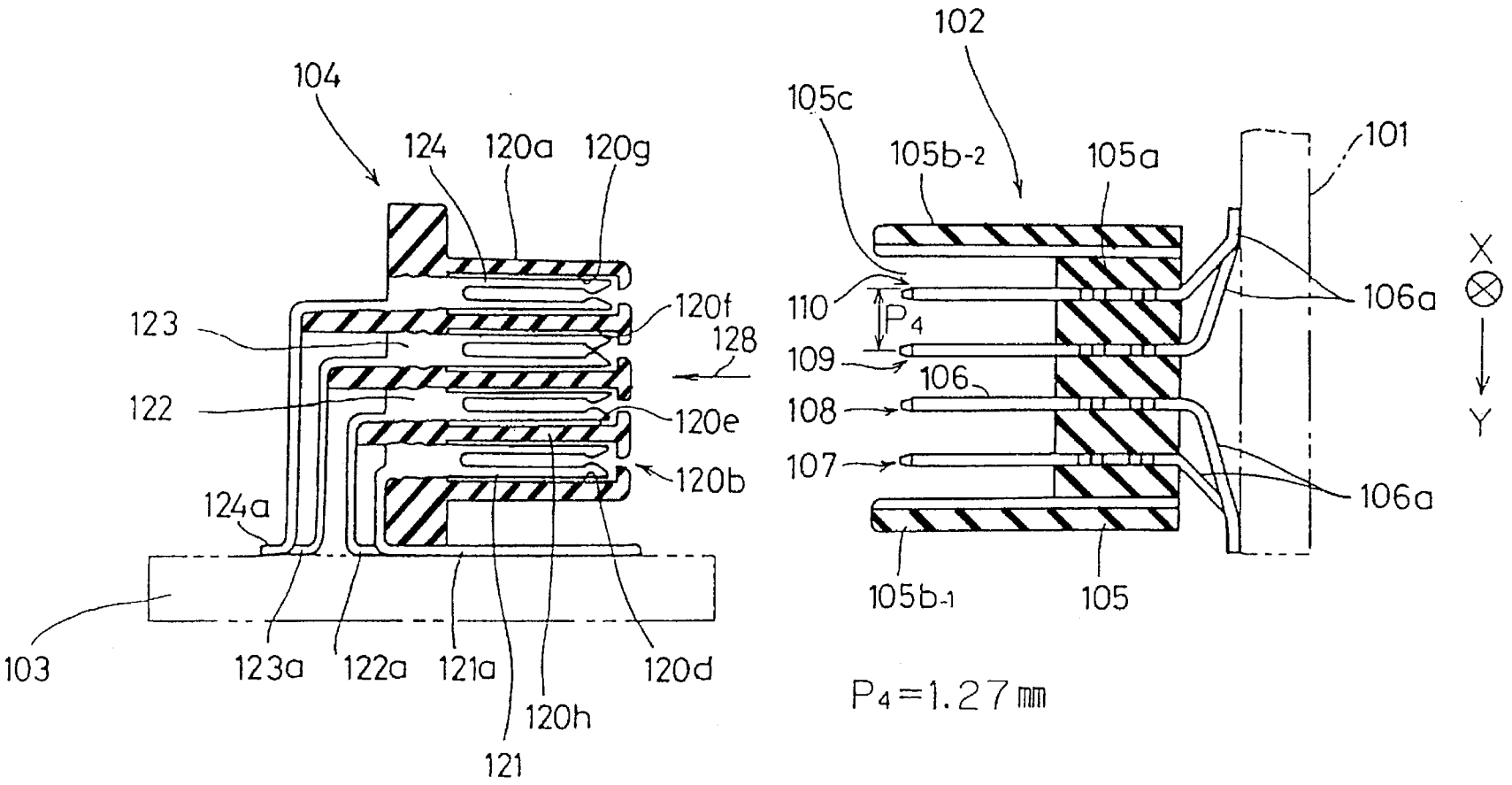
FIG. 8 is a cross sectional view showing the embodiment along a line III—III in FIG. 7.
Figure 9:
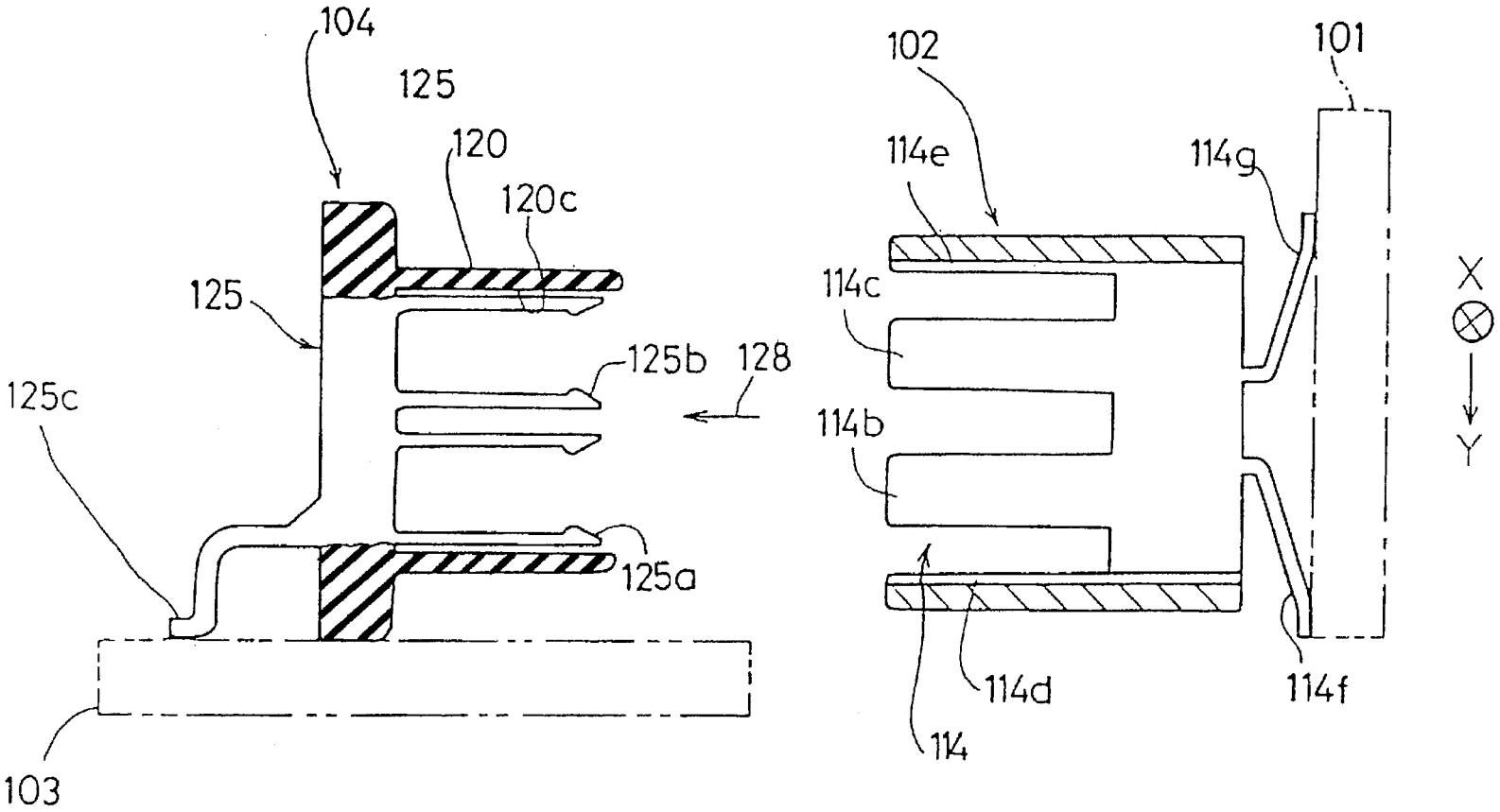
FIG. 9 is a cross sectional view showing the embodiment along a line IV—IV in FIG. 7.
Figure 10:
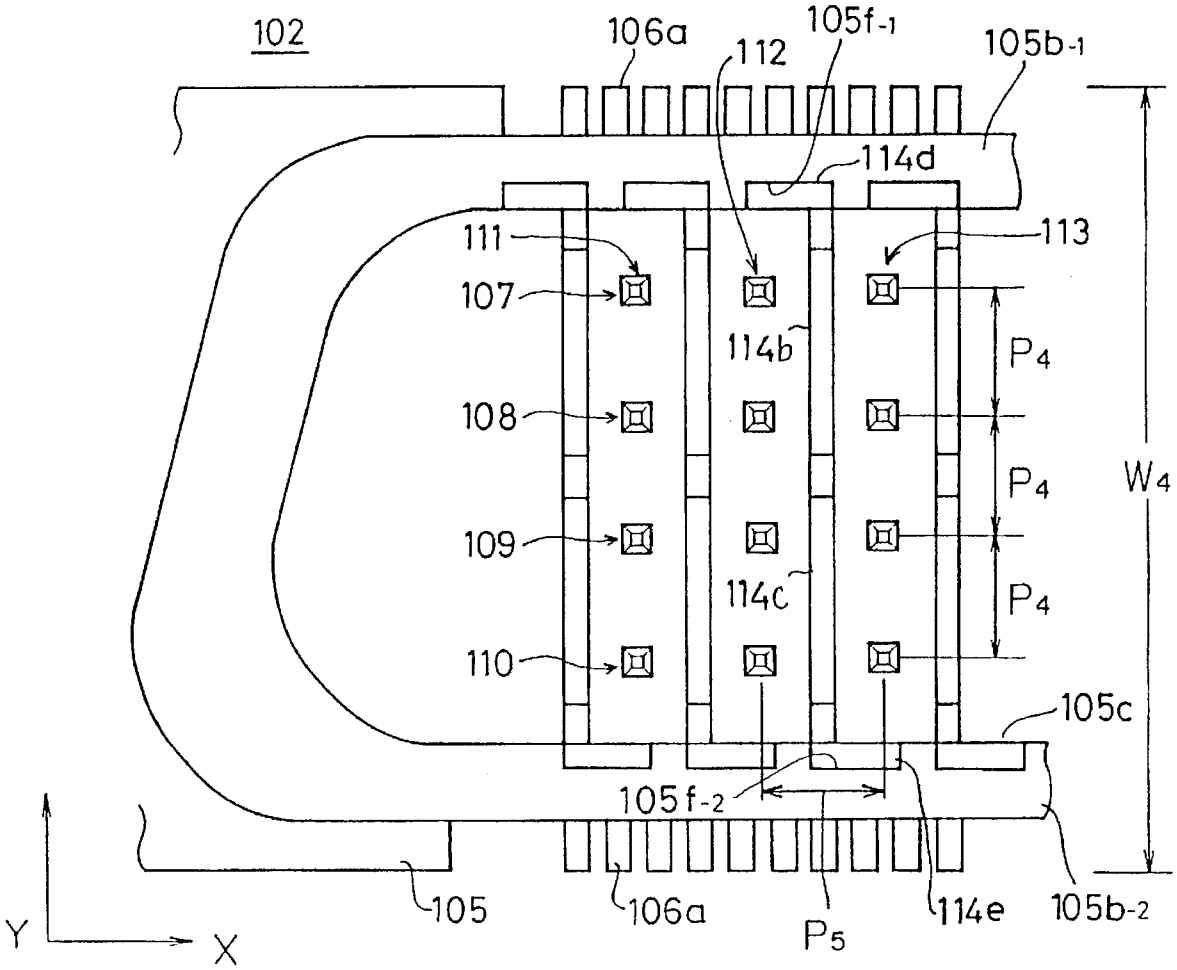
FIG. 10 is an enlarged plan view showing a plug connector member of the embodiment.
Figure 11:
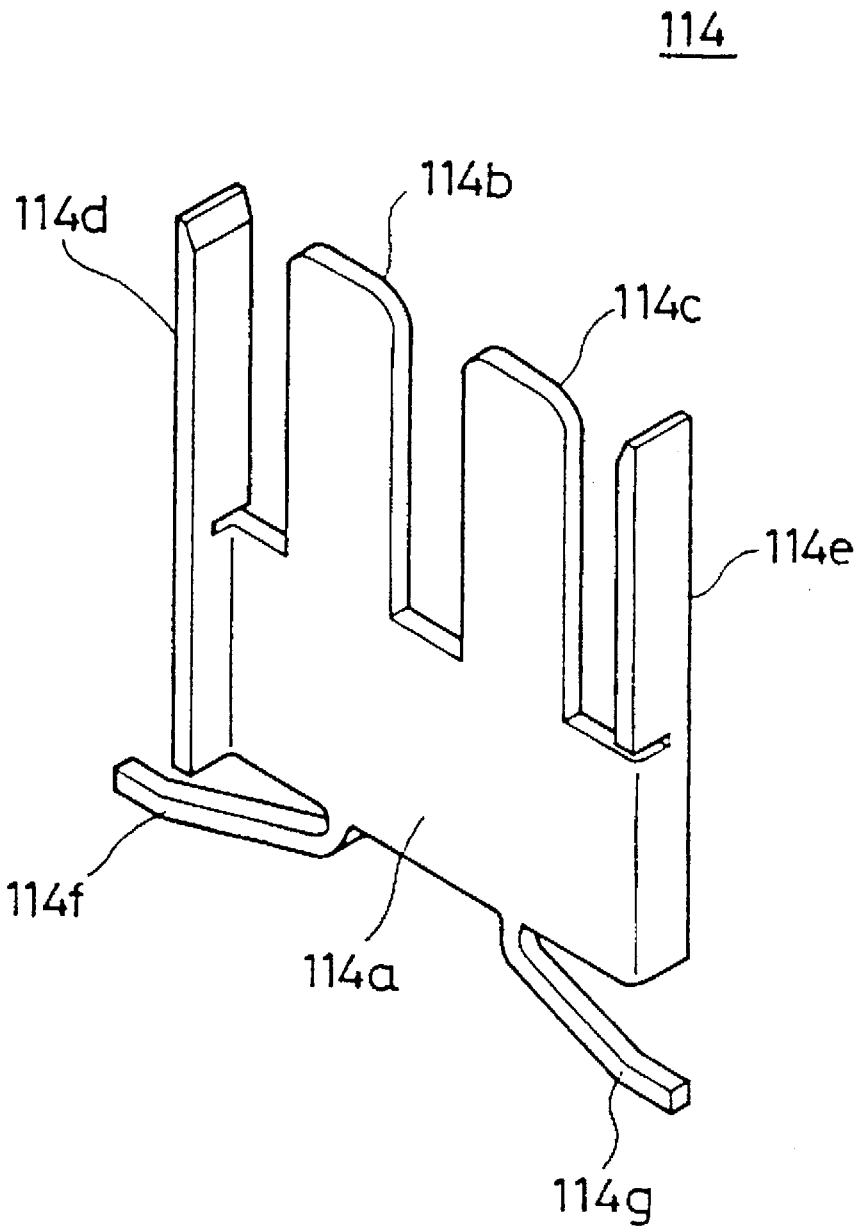
FIG. 11 is a perspective view showing a male conductor of the embodiment.
Figure 12:
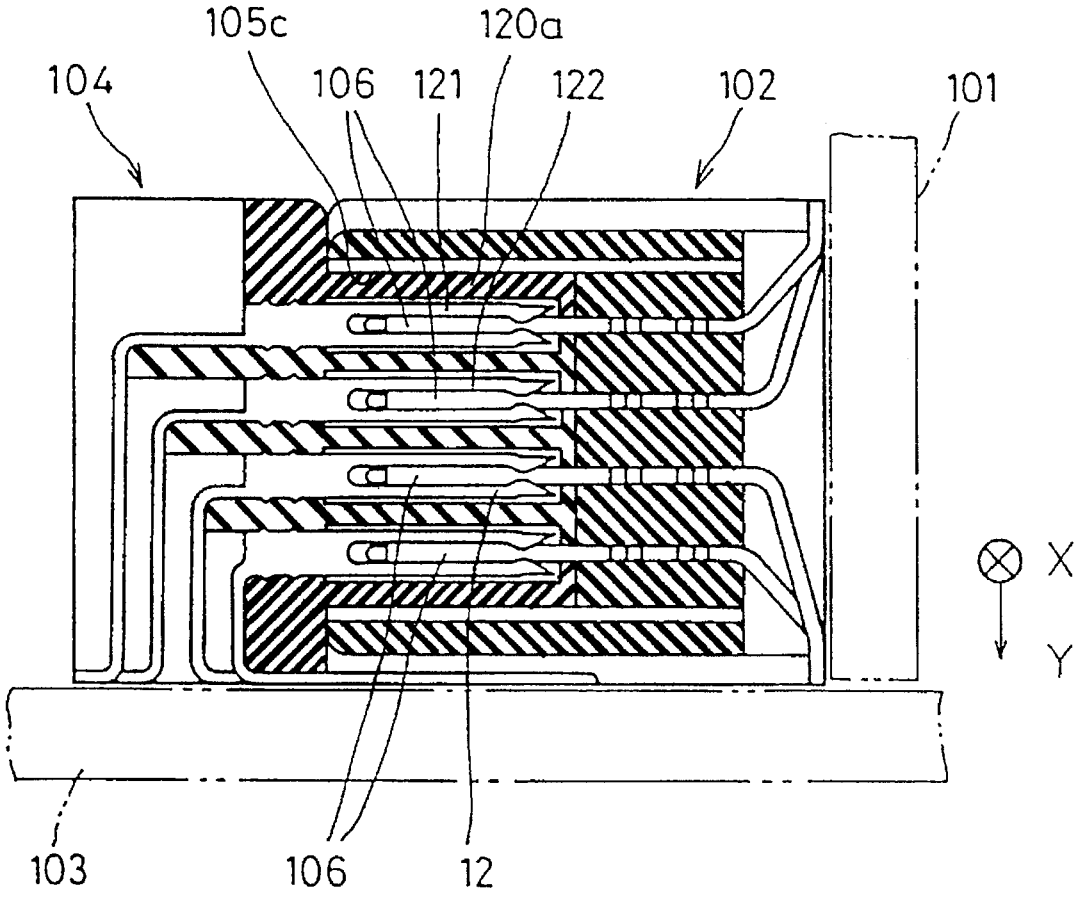
FIG. 12 is a cross sectional view showing male signal terminals in a connected state.
Figure 13:
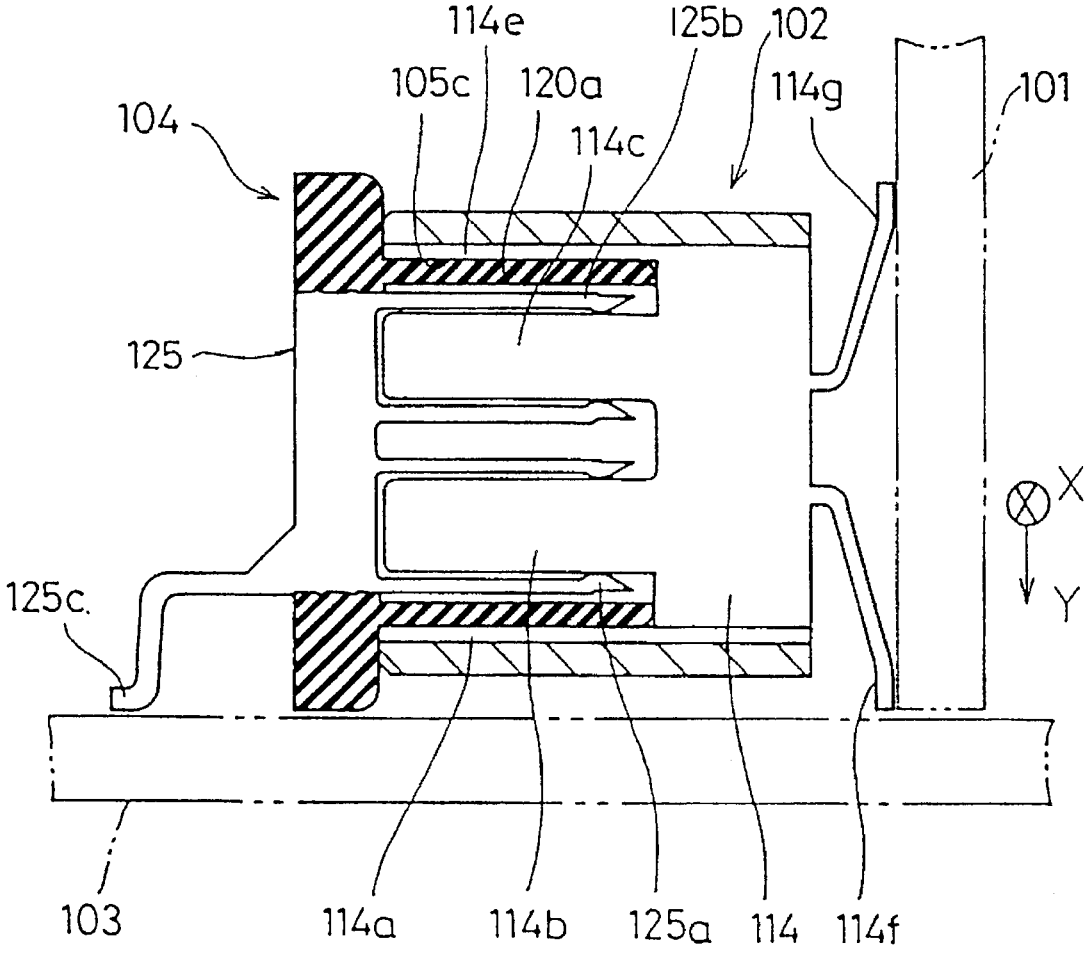
FIG. 13 is a cross sectional view showing a male conductor in a connected state.
Figure 14:
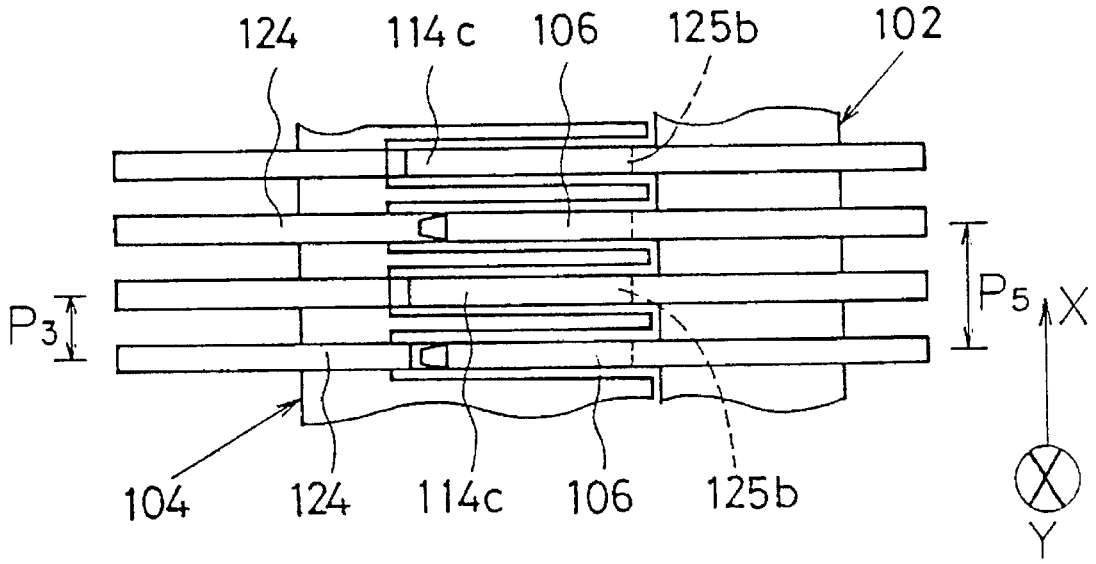
FIG. 14 is a cross sectional view showing the embodiment along a line IX—IX in FIG. 7 in a state where the plug connector member is connected.
Figure 15:
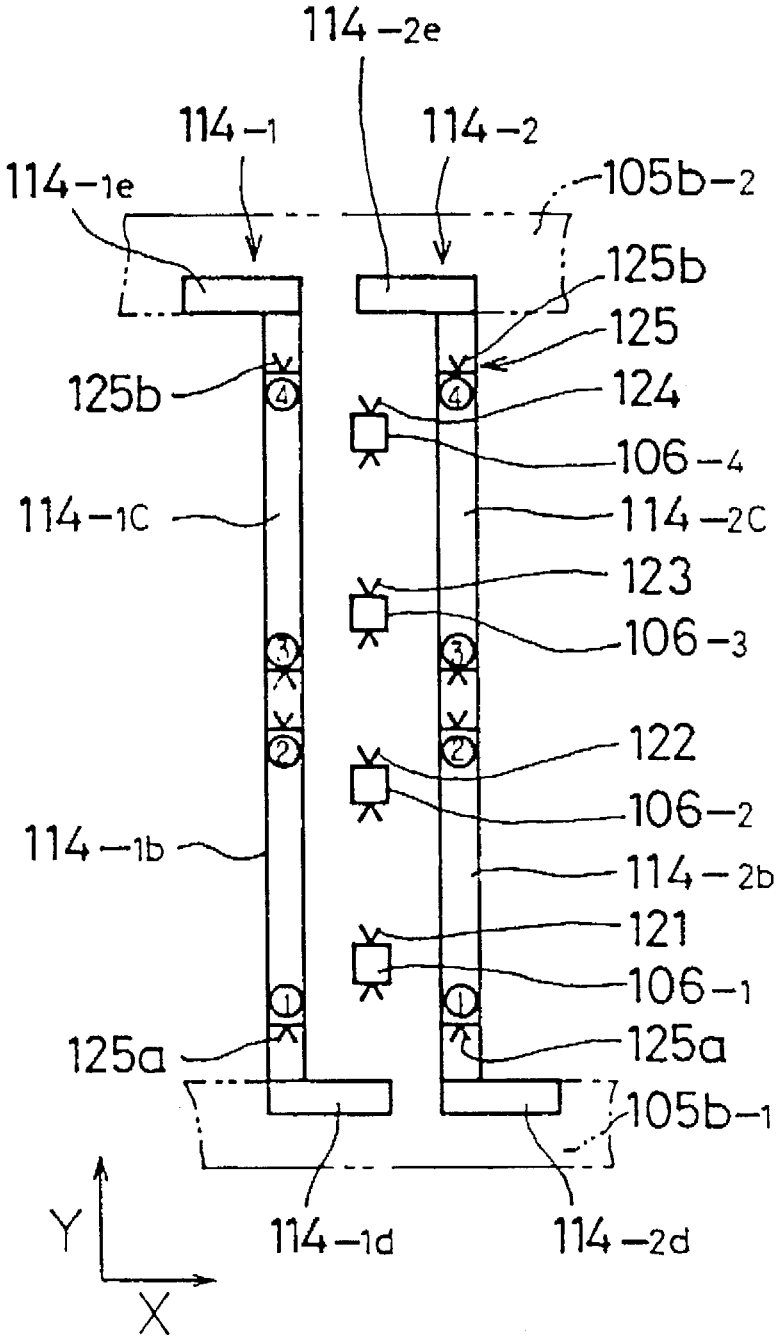
FIG. 15 is a diagram for explaining the impedance matching.

FIG. 7 shows a perspective view of the embodiment, FIG. 8 shows a cross sectional view of the embodiment along a line III—III in FIG. 7, and FIG. 9 shows a cross sectional view of the embodiment along a line IV–IV in FIG. 7. FIG. 10 shows an enlarged plan view of a plug connector member of the embodiment, and FIG. 11 shows a perspective view of a male conductor of the embodiment. FIG. 12 shows a cross sectional view of male signal terminals in a connected state, and FIG. 13 shows a cross sectional view of a male conductor in a connected state. In addition, FIG. 14 shows a cross sectional view of the embodiment along a line IX—IX in FIG. 7 in a state where the plug connector member is connected, and FIG. 15 is a diagram for explaining the impedance matching.

In this embodiment, an impedance matching type electrical connector 100 shown in FIG. 7 includes a plug connector member 102 fixed on a CPU board 101, and a jack connector member 104 fixed on a mother board 103, as also shown in FIGS.8 and 9.

First, a description will be given of the plug connector member 102.

The plug connector member 102 includes a plug housing 105 which is molded from a synthetic resin that is electrically an insulator. This plug housing 105 includes a base portion 105*a*, and peripheral sidewalls 105*b*-1 and 105*b*-2. A recess 105*c* is formed at a portion surrounded by the peripheral sidewalls 105*b*-1 and 105*b*-2. A plurality of penetrating holes 105*d* and slits 105*e* are provided in the base portion 105*a*. In addition, a plurality of grooves 105*f* are formed on inner surfaces of the peripheral sidewalls 105*b*-1 and 105*b*-2.

Each male signal terminal 106 has a pin shape having a square cross section. The male signal terminal 106 is press-fit and fixed within the corresponding penetrating hole 105*d*, and projects within the recess 105*c*.

In FIG. 10, an arrangement of the male signal terminals 106 in a direction X will be referred to as a "column", and an arrangement of the male signal terminals 106 in a direction Y will be referred to as a "row". The direction X coincides with the longitudinal direction of the plug connector member 102, and the direction Y coincides with the direction taken along the width of the plug connector member 102.

In this embodiment, a total of 280 male signal terminals 106 are provided. First, second, third and fourth columns 107, 108, 109 and 110 of the male signal terminals 106 respectively have 70 male signal terminals 106 arranged in-line. Furthermore, first, second, third, . . . , seventieth rows 111, 112, 113, . . . of the male signal terminals 106 respective have 4 male signal terminals 106 arranged in-line.

Each male signal terminal 106 has a signal lead end 106*b* on a lower end thereof. The signal lead ends 106*b* of the male signal terminals 106 in the first and second columns 107 and 108 are drawn out on the side of the peripheral sidewall 105*b*-1. In addition, the signal lead ends 106*b* of the male signal terminals 106 in the third and fourth columns 109 and 110 are drawn out on the side of the peripheral sidewalls 105*b*-2.

Plate-shaped male conductors 114 shown in FIG. 11 are press-fit and fixed within the respective slits 105*e*. The male conductor 114 includes a main body portion 114*a*, two plate portions 114*b* and 114*c* arranged side by side and projecting upwards in FIG. 11 from the main body portion 114*a*, elongated ear portions 114*d* and 114*e* provided on respective ends of the main body portion 114*a* and bent in mutually opposite directions, and ground lead ends 114*f* and 114*g* projecting downwards from the main body portion 114*a* in FIG. 11.

As shown in FIGS.7 and 10, the two plate portions 114*b* and 114*c* project within the recess 105*c* between two adjacent rows. The ear portions 114*d* and 114*f* fit within respective grooves 105*f*-1 and 105*f*-2 of the plug housing 105.

The male conductor 114 has an approximate Z-shape when viewed from above. Hence, the male conductor 114 can be press-fit and fixed within the slit 105*e* in a stable manner without being slanted, even if the right and left sides are reversed in FIG. 11.

The ear portions 114*d* and 114*f* fit into the corresponding grooves 105*f*-1 and 105*f*-2 and are positionally restricted thereby. In addition, the ear portions 114*d* and 114*f* are embedded within the respective peripheral sidewalls 105*b*-1 and 105*b*-2, and do not project within the recess 105*c*.

The ground lead ends 114*f* and 114*g* are respectively positioned between two signal lead ends 106*b*, and are arranged in line with the signal lead ends 106*b*.

The plug connector member 102 having the above described construction is fixed on the CPU board 101 by soldering the signal lead ends 106*b* on signal pads (not shown) on the CPU board 101 and soldering the ground leads 114*f* and 114*g* on ground pads (not shown) on the CPU board 101.

Next, a description will be given of the jack connector member 104.

As shown in FIG. 7, the jack connector member 104 includes a jack housing 120 which is molded from a synthetic resin that is electrically an insulator. The jack housing 120 includes a fitting portion 120*a* having a size corresponding to that of the recess 105*c*. A row of holes 120*b* shown in FIG. 8 and a slit 120*c* shown in FIG. 9 are alternately arranged in the fitting portion 120*a* in the longitudinal direction of the jack connector member 104.

As shown in FIG. 8, the row of holes 120*b* includes 4 holes 120*d*, 120*e*, 120*f* and 120*g*. Fork-shaped female signal terminals 121, 122, 123 and 124 are respectively press-fit and fixed within the corresponding holes 120*d*, 120*e*, 120*f* and 120*g*. The forks of the female signal terminals 121, 122, 123 and 124 are arranged in the direction Y, that is, in the direction in which the row extends.

On the other hand, as shown in FIG. 9, a fork-shaped female conductor terminal 125 is press-fit and fixed within the slit 120*c*. The female conductor terminal 125 includes two fork-shaped terminal portions 125*a* and 125*b* in correspondence with the two plate-shaped portions 114*b* and 114*c*. The forks of the fork-shaped terminal portions 125*a* and 125*b* are arranged in the direction Y, that is, in the direction in which the row extends.

The female signal terminals 121 through 124 and the female conductor terminals 125 are respectively formed by punching using a press, and are both thin and less expensive compared to the case where the terminals are formed by being a plate member.

In addition, since the forks of the female signal terminals 121 through 124 and the female conductor terminals 125 are respectively arranged in the direction Y, the female signal terminal (122, 123 and 124) and the female conductor terminal 125 are generally in a state where two plates overlap, and a gap $P_3$ between the two is considerably small.

The jack connector member 104 is fixed on the mother board 103 by soldering signal lead ends 121*a* through 124*a* extending from the female signal terminals 121 through 124 on signal pads (not shown) on the mother board 103 and soldering ground lead ends 125*c* extending from the female conductor terminals 125 on ground pads (not shown) on the mother board 103.

Next, a description will be given of a state where the plug connector member 102 is connected to the jack connector member 104, that is, a state where the CPU board 103 and the mother board 101 are electrically connected.

In FIGS.8 and 9, the plug connector member 102 is moved in a direction of an arrow 128 and connected to the jack connector member 104.

As shown in FIGS.12, 13 and 14, the fitting portion 120*a* fits within the recess 105*c*. Hence, the male signal terminals 106 fit within the corresponding holes 120*d* through 120*g*, and the plate portions 114*b* and 114*c* are guided by the corresponding slits 120c and fit within the slits 120*c*. In this state, the fork-shaped female signal terminals 121, 122, 123 and 124 relatively pinch the male signal terminals 106. As a result, one fork-shaped terminal portion 125*a* of the female conductor terminal 125 relatively pinches one plate portion 114*b*, and the other fork-shaped terminal portion 125*b* relatively pinches the other plate portion 114*c*. Therefore, the plug connector member 102 and the jack connector member 104 become connected.

The male signal terminals 106 are connected to the female signal terminals 121, 122, 123 and 124, thereby connecting signal lines. On the other hand, the male conductors 114 are connected to the female conductor terminals 125, thereby setting the potential of the plate portions 114*b* and 114*c* to the ground level.

As shown in FIGS.12, 14 and 15, the female signal terminals 121, 122, 123 and 124 pinch the male signal terminals 106-1, 106-2, 106-3 and 106-4 which form one row, in the direction Y. In addition, as shown in FIGS.13, 14 and 15, the fork-shaped terminal portions 125*a* and 125*b* of the female conductor terminal 125 pinch the plate portions 114*b* and 114*c* in the direction Y.

Next, a description will be given of the dimensions of the electrical connector 100 described above.

[1] Width Taken Along the Direction Y (FIGS. 7, 8, 9 and 10)

(i) Plug Connector Member 102

No obstructing structure is interposed between two adjacent columns out of the columns 107 through 110 of the male signal terminals 106. Accordingly, a pitch between two adjacent columns of the male signal terminals 106 can be reduced with a relatively high degree of freedom.

(ii) Jack Connector Member 105

The female signal terminals 121 through 124 are respectively inserted into the independent holes 120*d* through 120*g*. In addition, the fork portions are deformed in the direction Y.

(iii) Conclusion

Therefore, a pitch $P_4$ between two adjacent columns of the male signal terminals 106 is determined by the jack connector member 105. Only a partitioning wall 120*h* shown in FIG. 8 exists between two adjacent ones of the male signal terminals 121 through 124, and the intervals of the male signal terminals 121 through 124 can be made sufficiently small. Accordingly, the pitch $P_4$ between two adjacent columns of the male signal terminals 106 is 1.27 mm and small in this embodiment. Consequently, although four columns of male signal terminals 106 are provided, a width $W_4$ of the plug connector 102 is 12.7 mm and small.

[2] Length Taken Along the Direction X (FIGS.7 and 10)

(i) Plug Connector Member 102

The male conductor 114 is arranged between the rows 111, 112 and the like of the male signal terminals 106. However, since the male conductor 114 has a plate shape, a pitch between two adjacent rows of the male signal terminals 106 can also be reduced with a relatively high degree of freedom.

(ii) Jack Connector Member 105

The female signal terminals 121 through 124 and the female conductor terminals 125 are alternately arranged. The female signal terminal 121 and the female signal terminal 125 both have the fork shape, and these terminals 121 and 125 are aligned in a direction taken along the thickness thereof. For this reason, a gap P3 between the terminals 121 and 125 is 1.27 mm and small.

(iii) Conclusion

Therefore, a pitch $P_5$ between two adjacent rows of the male signal terminals 106 is 1.27 mm and small in this embodiment. Hence, even when 70 rows of the male signal terminals 106 are arranged, a length L of the plug connector member 102 is only 165 mm and relatively short compared to the large number of rows. Accordingly, the size $W_4 \times L$ of the electrical connector 100 is 12.7 mm×165 mm and small even though the number of terminals is 280 and considerably large compared to the conventional electrical connector.

Next, a description will be given of the impedance matching of the male signal terminals 106-1 through 106-4 of one row and the female signal terminals 121 through 124, by referring to FIG. 15.

The potentials of plate portions 114-1*b*, 1141*c*, 114-2*b* and 114-2*c* and ear portions 114-1*d*, 114-1*e*, 114-2*d* and 114-2*e* are respectively set to the ground level.

With respect to the male conductor terminal 106-1 and the female conductor terminal 121 which form the first column and make the fitting engagement, the plate portions 114-1*b* and 114-2*b* draw near from both sides along the direction X and confront at equal distances, the ear portion 114-1*d* confronts from one side along the direction Y, and the ear portion 114-2*e* confronts from the other side along the direction Y although at a distance, thereby forming the strip line structure.

With respect to the male conductor terminal 106-2 and the female conductor terminal 122 which form the second column and make the fitting engagement, the plate portions 114-1*b* and 114-2*b* draw near from both sides along the direction X and confront at equal distances, and the ear portions 114-1*d* and 114-2*e* confront from both sides along the direction Y although at a distance, thereby forming the strip line structure.

The strip line structure is formed similarly with respect to the male conductor terminal 106-3 and the female conductor terminal 123 which form the third column, and with respect to the male conductor terminal 106-4 and the female conductor terminal 124.

In addition, the individual male conductors 114 and the female conductor terminals 125 make contact at four positions indicated by circled reference numerals 1, 2, 3 and 4 in FIG. 15, at both sides of the plate portions 114-1*b* and 114-1*c* along the direction taken along the width of the plate portions 114-1*b* and 114-1*c*. For this reason, the contact resistance between the male conductor 114 and the female conductor 125 is small.

Therefore, the electrical connector 100 has a stable characteristic such that the impedance is concentrated in a vicinity of 50Ωfor all of the 280 pins, and the impedance is matched satisfactorily for all of the 280 pins. In addition, the crosstalk between the terminals is small.

Next, a description will be given of the structure which is employed as a measure against electro-magnetic interference (EMI).

As shown in FIG. 15, the ear portions 114-1*d*, 114-2*d*, 114-1*e* and 114-2*e* are approximately connected and are arranged along the inner walls of the peripheral sidewalls 105*b*-1 and 105*b*-2. These ear portions 114-1*d*, 114-2*d*, 114-1*e* and 114-2*e* which are arranged prevent the electromagnetic waves from intruding within the electrical connector 100.

In the described embodiment, the male signal terminals are arranged in 4 columns and 70 rows, however, the numbers of columns and rows are of course not limited to those of the described embodiment.

Further, the present invention is not limited to these embodiments, but various variations and modifications may be made without departing from the scope of the present invention.

What is claimed is:

1. A plug connector comprising:

a plug housing made of an insulator material;

a plurality of male signal terminals arranged in a plurality of columns and rows and fixed to said plug housing; and plate-shaped male conductors respectively having ground lead ends and fixed to said plug housing so that each male conductor is positioned between two adjacent rows formed by said male signal terminals, each male conductor further has first and second ear portions bent on both ends of the male conductor in a direction taken along a width of the male conductor, said first ear portions confront the individual male signal terminals which form a respective first column and are arranged along said respective first column, and said second ear portions confront the individual male signal terminals which form a respective second column and are arranged along said respective second column.

2. The plug connector as claimed in claim 1, wherein said first and second ear portions are bent in mutually opposite directions on both ends of each male conductor.

3. The plug connector as claimed in claim 1, wherein:

said plug housing includes peripheral sidewalls forming a recess, said peripheral sidewalls have grooves on inner peripheral surface thereof, each male conductor has first and second ear portions bent on both ends of the male conductor in a direction taken along a width of the male conductor, and said first and second ear portions fit within the corresponding grooves of said peripheral sidewalls.

4. The plug connector as claimed in claim 1, which is fixed on a CPU board of a computer system, said CPU board being mounted with a central processing unit.

5. A jack connector comprising:

a jack housing made of an insulator material;

a plurality of fork-shaped female signal terminals arranged in a plurality of columns and rows and fixed to said jack housing so that forks of said female signal terminals face a direction in which the rows extend; and a plurality of fork-shaped female conductor terminals respectively having a thickness, a ground lead end and fixed to said Jack housing so that each female conductor terminal is positioned between two adjacent rows formed by the female signal terminals and forks of said female conductor terminals face a direction in which the rows extend, wherein each of said fork-shaped female conductor terminals has a plane body portion with arms extending therefrom and lying entirely in the plane of the body portion each of said arm has a side surface extending in a direction of the thickness of the fork-shaped female conductor terminal capable of contacting a corresponding side surface of a corresponding male conductor terminal of a plug connector when the jack connector and the plug connector engage with each other, the male conductor terminal having a planar contact section extending in a direction of a thickness of the male conductor terminal so that the jack connector and the plug connector engage with each other.

6. The jack connector as claimed in claim 5, which is fixed on a mother board of a computer system.

7. The jack connector according to claim 6, wherein each of said fork-shaped female conductor terminals has two fork-shaped terminal portions and when each of the male conductor terminals of the plug connector is inserted into corresponding fork-shaped female conductor terminal of the jack connector, the fork-shaped terminal portions of each of the fork-shaped female conductor terminals extend in a direction parallel to a plane on which a plate forming the fork-shaped female conductor terminal extends.

8. The jack connector according to claim 7, wherein the fork-shaped female conductor terminals are arranged approximately parallel to the male conductor terminals when the jack connector and the plug connector are engaged, each fork-shaped female conductor terminal has the two fork-shaped terminal portions which pinch the corresponding male conductor terminal therebetween.

9. The jack connector according to claim 7, wherein a portion of the terminals of the jack connector are bent around a lower side of the jack connector.

10. An impedance matching type electrical connector comprising:

a plug connector member; and a jack connector member engageable to said plug connector, said plug connector member comprising:

a plug housing made of an insulator material;

a plurality of male signal terminals arranged in a plurality of columns and rows and fixed to said plug housing; and plate-shaped male conductors respectively having ground lead ends and fixed to said plug housing so that each male conductor is positioned between two adjacent rows formed by said male signal terminals, said jack connector member comprising:

a jack housing made of an insulator material;

a plurality of fork-shaped female signal terminals, adapted to engage the male signal terminals of said plug connector member when said jack connector member and said plug connector member connect, and arranged in a plurality of columns and rows and fixed to said jack housing so that forks of said female signal terminals face a direction in which the rows extend; and a plurality of fork-shaped female conductor terminals respectively having a ground lead end and fixed to said jack housing so that each female conductor terminal is positioned between two adjacent rows formed by the female signal terminals and the forks of said female conductor terminals face a direction in which the rows extend, each male conductor further has plate portions, and first and second ear portions bent on both ends of the male conductor in a direction taken along a width of the male conductor on both sides of the plate portions, said first ear portions confront the individual male signal terminals which form a respective first column and are arranged along said respective first column, said second ear portions confront the individual male signal terminals which form a respective second column and are arranged along said respective second column, and said plate portions of said male conductors engage said female conductor terminals when said jack connector member and said plug connector member connect.

11. The impedance matching type electrical connector as claimed in claim 10, wherein:

each female conductor terminal has a pair of fork-shaped terminal portions, and each fork-shaped terminal portion pinches the plate portion of a corresponding one of said male conductors and makes contact at four positions of the plate portion.

12. The impedance matching type electrical connector as claimed in claim 10, wherein:

said plug connector member is fixed on a CPU board which is mounted with a central processing unit, said jack connector member is fixed on a mother board, and said CPU board and said mother board are elements of a computer system.

13. The jack connector according to claim 10, wherein:

each of said fork-shaped conductor terminals has two fork-shaped terminal portions and when the male conductor terminals of the plug connector is inserted into corresponding fork-shaped female conductor terminals of the jack connector, fork-shaped terminal portions of each of the fork-shaped female conductor terminals are deformed in a direction parallel to a plane on which a plate forming the fork-shaped female conductor terminal extends;

the fork-shaped female conductor terminals are arranged approximately parallel to the male conductor terminals when the jack connector and the plug connector are engaged, each fork-shaped female conductor terminal has the two fork-shaped terminal portions which pinch the corresponding male conductor terminal therebetween; and a portion of the terminals of the jack connector are bent around lower side of the jack connector.

14. The jack connector according to claim 10, wherein each of said fork-shaped female conductor terminals has two fork-shaped terminal portions and when each of the male conductor terminals of the plug connector is inserted into corresponding fork-shaped female conductor terminal of the jack connector, the fork-shaped terminal portions of each of the fork-shaped female conductor terminals extend in a direction parallel to a plane on which a plate forming the fork-shaped female conductor terminal extends.

15. A plug connector comprising:

a plug housing made of an insulator material;

a plurality of male signal terminals arranged in a plurality of columns and rows and fixed to said plug housing; and plate-shaped male conductors respectively having ground lead ends and fixed to said plug housing so that each male conductor is positioned between two adjacent rows formed by said male signal terminals, wherein:

said plug housing includes peripheral sidewalls forming a recess, said peripheral sidewalls have grooves on ear peripheral surfaces thereof, each male conductor has first and second ear portions bent on both ends of the male conductor in a direction taken along a width of the male conductor, and said first and second ear portions fit within the corresponding grooves of said peripheral sidewalls.

* * * * *

UNITED STATES PATENT AND TRADEMARK OFFICE

CERTIFICATE OF CORRECTION

PATENT NO. : 5,645,436

DATED : July 8, 1997

INVENTOR(S) : SHIMIZU et al.

It is certified that error appears in the above-identified patent and that said Letters Patent is hereby corrected as shown below:

Col. 11, line 40 (Claim 3, line 5), change "surface" to --surfaces--;
line 65 (Claim 5, line 16), after "portion" insert --,--;
line 66 (Claim 5, line 17), change "arm" to --arms--.

Col. 12, line 11 (Claim 7, line 1), change "6" to --5--.

Col. 13, line 24 (Claim 13, line 1), change "jack" to --impedance matching type electrical--.

Col. 14, line 7 (Claim 14, line 1), change "jack" to --impedance matching type electrical--.

Signed and Sealed this

Tenth Day of February, 1998

*Attest:*

*Attesting Officer*

BRUCE LEHMAN

*Commissioner of Patents and Trademarks*